United States Patent [19]

Hänsch

[11] 4,398,710

[45] Aug. 16, 1983

[54] METHOD AND APPARATUS FOR OPENING FOLDED, BOUND OR STITCHED MULTI-SHEET PRODUCTS, ESPECIALLY PRINTED PRODUCTS

[75] Inventor: Egon Hänsch, Wetzikon, Switzerland

[73] Assignee: Ferag AG, Hinwil, Switzerland

[21] Appl. No.: 214,460

[22] Filed: Dec. 8, 1980

[30] Foreign Application Priority Data

Jan. 8, 1980 [CH] Switzerland ..... 100/80

[51] Int. Cl.[3] ..... B65H 5/30

[52] U.S. Cl. ..... 270/55

[58] Field of Search ..... 270/55, 57; 53/266 A

[56] References Cited

U.S. PATENT DOCUMENTS

| | | | |
|---|---|---|---|
| 1,441,278 | 1/1923 | Halvorsen | 270/55 |
| 3,420,516 | 1/1969 | Guggisberg | 270/55 |
| 3,951,399 | 4/1976 | Reist | 270/55 |

*Primary Examiner*—A. J. Heinz

*Attorney, Agent, or Firm*—Werner W. Kleeman

[57] ABSTRACT

An entrainment cam, which is attached to an arm displaceable in its lengthwise direction, is moved toward an open side of a printed product which is to be opened. At the region of one corner of the product the entrainment cam engages a part of the printed product and entrains the seized sheets during further movement thereof. This results in a bowing-out or bulging of the entrained product sheets, so that the part of the printed product which is not engaged by the entrainment cam can be raised. In the thus formed gap there is inserted a holder element which supports the part of the printed product not engaged by the entrainment cam and in this way retains the gap open. Now the entrainment cam is moved back into its rest position where it does not have any effect upon the printed product. The latter then is forwardly advanced, in a direction essentially parallel to the product fold, towards a separation element which engages into the gap and completely opens the printed product.

22 Claims, 3 Drawing Figures

METHOD AND APPARATUS FOR OPENING FOLDED, BOUND OR STITCHED MULTI-SHEET PRODUCTS, ESPECIALLY PRINTED PRODUCTS

CROSS REFERENCE TO RELATED CASE

This application is related to the commonly assigned copending United States application Ser. No. 06/214,461, filed Dec. 8, 1980.

BACKGROUND OF THE INVENTION

The present invention relates to a new and improved method of, and apparatus for, opening folded, bound or stitched multi-sheet products, especially printed products.

Generally speaking, the method and apparatus of the present development is of the type wherein, by means of a preseparation element, a portion of the sheets are displaced in relation to the remaining sheets of the product while forming an opening.

In German Patent Publication No. 2,447,336, published Apr. 17, 1975 and the corresponding U.S. Pat. No. 3,951,399, granted Apr. 20, 1976 there is disclosed an article opening device wherein a pressure element exerts a pressure or compressive force upon the product. This compressive force extends transversely with respect to a flat side of the product. Consequently, there is brought about a bowing-out of part of the product. In the thus formed gap there is introduced a separation element which completely opens the product. Since the mode of operation of this apparatus is predicated upon the presence of a pre-bias, caused by a product fold, in the product it is only possible to open with this technique certain types of products. Additionally, during the pre-separation the gap always tends to form between the sheets located at opposite sides of the fold, so that opening of the product at a different location is not readily possible.

A method and apparatus of the previously mentioned type is known from Swiss Pat. No. 521,911, granted Apr. 30, 1972. In this case a roll or roller co-travels along with the printed product, this roll pressing against a flat side of such product and its direction of movement however being oriented at an inclination with respect to the direction of movement of the product. Due to its movement component extending at right angles with respect to the direction of movement of the printed product this roll causes displacement of one part of the printed product in relation to its other part in the direction of the product fold. Such results in bowing-out of the displaced part of the product. For completely opening the product a separation element is introduced into the formed opening. However, if there are not employed special measures the printed product, as a rule, will be opened at its centre. If opening of the product is desired at another location, then it is necessary to reduce the friction between the product sheets located at the separation location, for instance, by applying a dry lubricant. Moreover, this known apparatus is afflicted with the drawback that due to the frictional contact or connection between the roll and the printed product there exists the danger that the product can be damaged.

Other prior art constructions of product handling equipment have been disclosed in U.S. Pat. Nos. 3,580,562, 3,692,301 and 3,722,877.

SUMMARY OF THE INVENTION

Therefore, with the foregoing in mind it is a primary object of the present invention to provide a new and improved construction of method and apparatus for opening folded, bound or stitched multi-sheet products, especially printed products, in a manner overcoming the drawbacks and shortcomings of the prior art constructions discussed heretofore.

Another and more specific object of the present invention aims at providing a method of, and apparatus for, opening folded, bound or stitched multi-sheet articles or products, which enables the faultless, simple and reliable opening of such multi-sheet products of different thickness at all times at a desired location and while protecting the product against damage.

Yet a further significant object of the present invention aims at providing a new and improved construction of apparatus for opening interconnected multi-sheet products in a manner not associated with the previously described drawbacks, and which apparatus is relatively simple in construction and design, economical to manufacture, quite easy to use, not readily subject to breakdown or malfunction, and requires a minimum of maintenance and servicing.

Now in order to implement these and still further objects of the invention, which will become more readily apparent as the description proceeds, the method of the present invention for opening folded, bound or stitched multi-sheet products, especially printed products, contemplates that the pre-separation element is moved relative to the product towards an open side of such product and a portion of the product sheets are engaged or seized, so that during the further or continued relative movement such sheets tend to bow-out at the seized or engaged region. A holder element is then introduced into the opening formed between the bowed-out sheets and the remaining sheets, and the sheets which have not been engaged by the pre-separation element come to bear upon such holder element.

As already mentioned heretofore, the invention is not only concerned with the previously described method aspects but also concerns apparatus for the practice thereof. According to a preferred embodiment of the invention the product opening apparatus contemplates providing the pre-separation element so as to be moveable relative to the product, towards an open side of the product, and engaging a portion of the sheets of the product, so that during further relative movement these sheets are bowed-out or domed at the seized or engaged region. A holder element is provided which can be introduced into the opening between the bowed-out sheets and the remaining sheets, and the sheets of the product which are not engaged by the pre-separation element come to bear upon the holder element.

Due to the construction of the pre-separation element it is possible to determine the number of sheets which are to be engaged by the pre-separation element. Consequently, there can be freely selected the location where the sheets are separated from one another, without having to subject the product to a pre-handling or treatment. As soon as the holder element which retains the separated sheets apart, has moved into the opening formed by the pre-separation element, then the pre-separation element can be moved back without the previously opened sheets again bearing at one another. The product now can be further moved, for instance, in the direction of a separation element, without retarding or otherwise affecting this movement by the pre-separation element.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
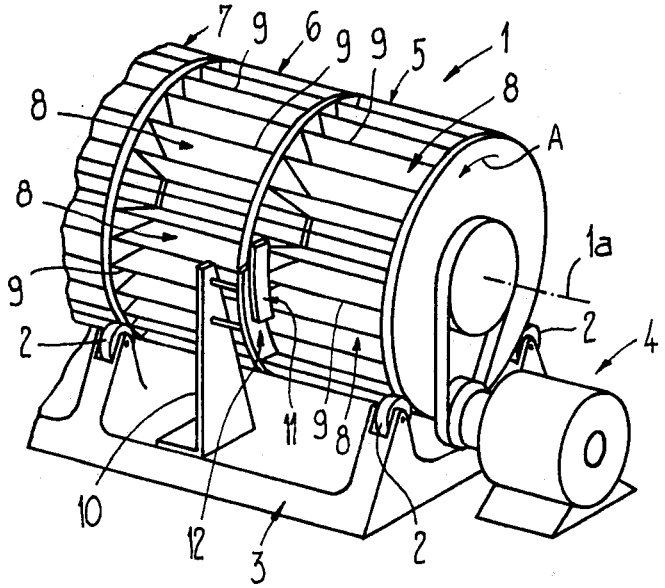
FIG. 1 is a perspective view of a portion of an apparatus for processing printed products with the aid of a cell wheel.
Figure 3:
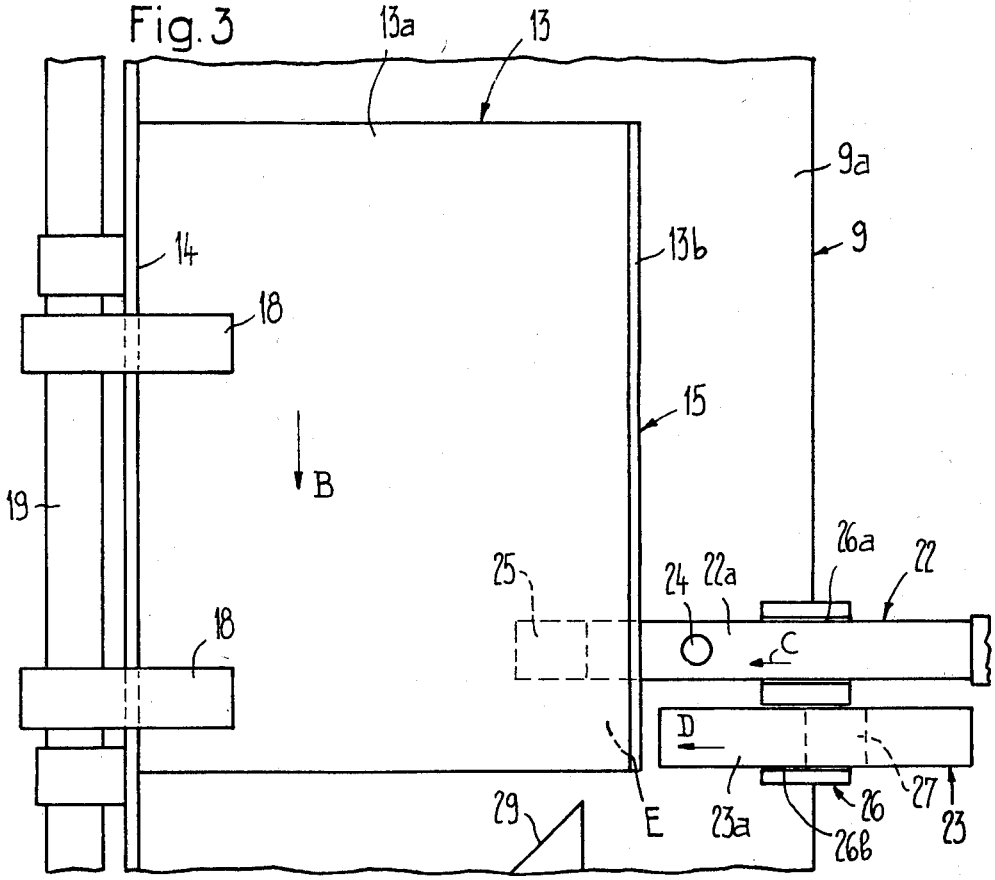
FIG. 3 is a sectional view of the arrangement of FIG. 2, taken substantially along the line III—III thereof.
Figure 2:
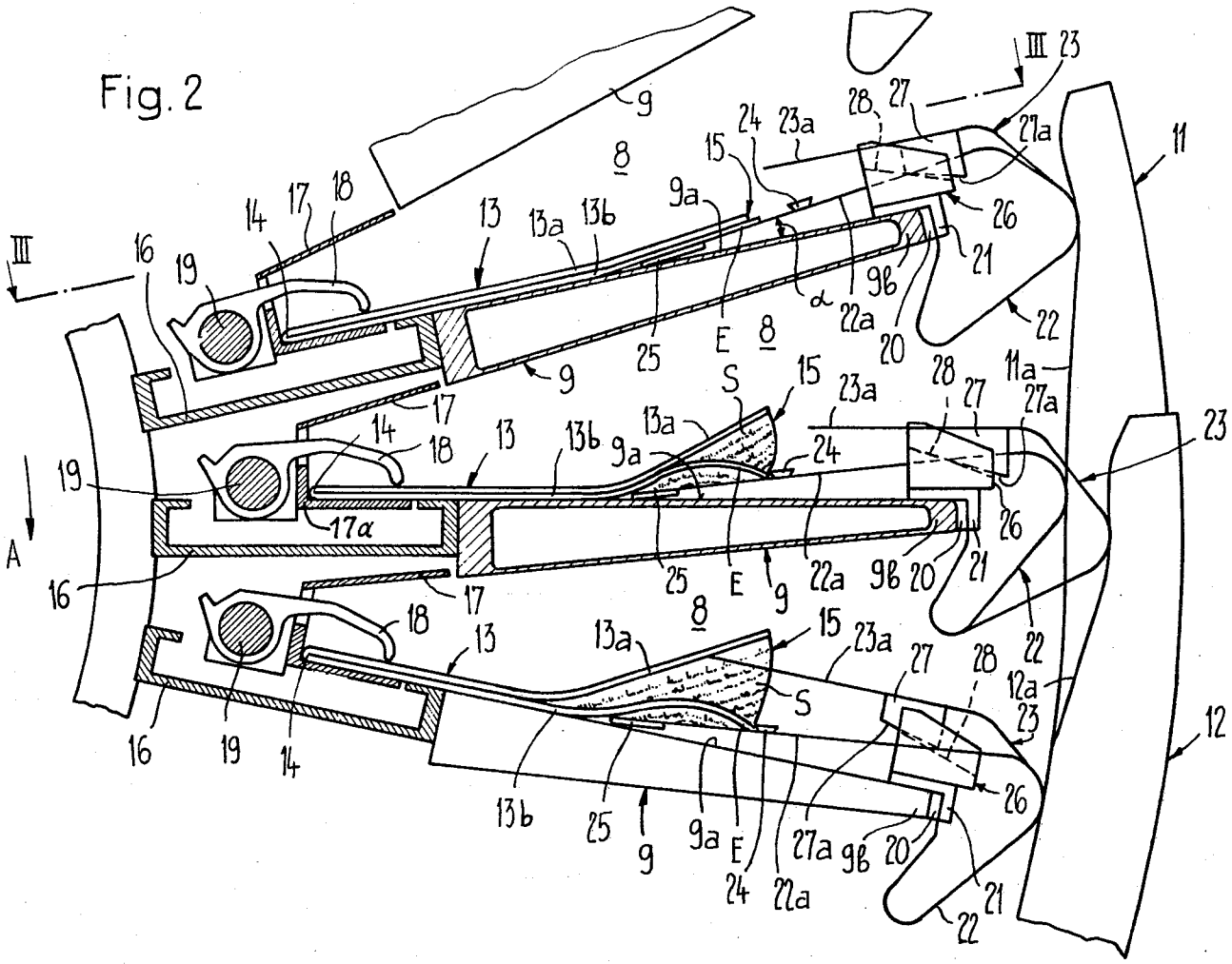
FIG. 2 is a sectional view, extending transversely with respect to the axis of the cell wheel of FIG. 1, of several compartments of the forwardmost portion of the cell wheel shown in FIG. 1.

Describing now the drawings, FIG. 1 shows in perspective view, while FIGS. 2 and 3 show in different sectional views, an apparatus for processing or handling printed products, extensively corresponding to the processing apparatus for printed products described in the aforementioned German Patent Publication No. 2,447,336 and the corresponding U.S. Pat. No. 3,951,399 as well as German Patent Publication No. 2,604,101, published Sept. 16, 1976 and the corresponding U.S. Pat. No. 4,058,202, to which reference may be readily had and the disclosure of which is incorporated herein by reference. For that reason it is unnecessary to provide any detailed discussion of the construction of such well known processing apparatus, apart from the general comments made hereinafter for the purpose of placing the invention of the instant application in its proper perspective. The aforementioned apparatus comprises a cell wheel 1 which is supported at its circumference upon rolls or rollers 2 which are mounted in a frame 3. By means of a suitable drive 4 this cell wheel 1 can be placed into rotation about its horizontal axis 1*a* in the direction of the arrow A. The cell wheel 1 is composed of different interconnected portions or sections 5, 6 and 7, each of which contains radially extending and outwardly open compartments 8. The individual compartments 8 are separated from one another by partition or separation walls 9. Furthermore, a support 10 is connected with the frame 3. At the support 10 there are provided two stationary cams or control brackets 11 or 12 or equivalent structure, the function of which will be described more fully hereinafter.

As particularly well seen by referring to FIG. 2, these compartments 8 serve for receiving folded printed products 13, which are inserted in the manner disclosed in the aforementioned U.S. Pat. No. 4,058,202 in radial direction into the compartments 8 of the infeed portion or section 5 and subsequently are displaced within the compartments 8 in the direction of the axis of rotation 1*a* of the cell wheel 1. These printed products 13 consist of two parts or portions 13*a* and 13*b*, each of which contains a number of sheets and which are interconnected with one another along a folded edge by a product fold 14. The side 15 defines a lap margin (the so-called leaf portion) of the product which is located opposite the product fold 14 is open, i.e. the sheets are not interconnected at this side 15. As best seen by referring to FIGS. 2 and 3, the printed products 13 bear by means of their product part or portion 13*b* upon a support surface 9*a* formed by the partition walls 9. In the illustrated exemplary embodiment there are processed printed products 13 containing a prefold, wherein the part 13*b* is wider than the upper part 13*a* which creates the lap margin. However, it should be understood that in the same manner it would be possible to open printed products devoid of any pre-fold.

As will be recognised by further inspecting FIG. 2, at the rear end of each compartment partition wall 9 there is attached a substantially C-shaped profile rail 16 at which there is guided a not particularly illustrated carriage. At each carriage there is secured an outwardly open holder or holder member 17, at whose base portion 17*a* there bear the printed products 13 by means of their fold 14. This carriage along with the holders 17 are displaced in any suitable manner in the direction of the axis of rotation 1*a* of the cell wheel, i.e. at right angles to the plane of the drawing of FIG. 2, as such has been described in detail in the aforementioned U.S. Pat. No. 4,058,202. In order to render possible, during rotation of the cell wheel 1, a faultless displacement of the printed products 13 in the axial direction of the cell wheel 1, there are provided gripper jaws 18 or equivalent structure. These gripper jaws 18 press the printed product 13 against a flange of the holder or holder member 17 which is connected with the carriage. These gripper jaws 18 are seated upon a gripper shaft 19. As to the operation and control of such gripper jaws 18 reference likewise can be made to the aforementioned U.S. Pat. No. 4,058,202.

In contrast to the previously discussed prior art systems, the opening of the printed products 13 is however accomplished with other means, which constitute the subject matter of the present invention and which now shall be discussed in greater detail hereinafter.

At the outer edge 9*b* of each compartment partition wall 9 of the forwardmost portion or section 5 of the cell wheel 1 there is mounted a flat iron element 20, between which and an angle iron element 21 there are attached two bending spring elements 22 and 23 at their one end. These bending spring elements 22 and 23 are arranged adjacent one another in the axial direction of the cell wheel 1. The bending spring elements 22 and 23, which are bent from a spring steel strip, protrude by means of their free ends 22*a* and 23*a* into the interior of the compartment 8. The clamped rear portion of the bending spring elements 22 and 23 is configured such that the bending spring elements 22 and 23 always bear against the control cam surfaces 11*a* and 12*a* of the stationary cams 11 and 12, as also will be recognised by referring to FIG. 1.

The part of the bending spring element 22 forming a pre-separation element carries at its free end 22*a* an entrainment dog or cam 24 which, in a manner still to be described, comes to act upon a part of the sheets of the product located in the compartment 8. The free end 22*a* of the bending spring element 22, serving as the support arm for the entrainment cam or dog 24, extends past the entrainment cam 24 into the compartment 8 and carries at its tip a slide element 25, by means of which this arm 22*a* bears upon the contact or support surface 9*a*. As best seen by referring to FIG. 2, the arm 22*a* forms along with the contact surface 9*a* an acute angle $\alpha$ of less than 10°. Upon insertion of the printed product 13 into the compartment 8 this printed product 13 comes to bear at the region of its corner E, where there should be accomplished a pre-opening operation, upon such arm 22*a* which extends at an inclination with respect to the support or contact surface 9*a*. At the opening region E the product 13 is thus raised and, because of its weight and the inherent tension or bias of the product, it bears flatly upon the arm 22*a*, so that also in the event of a possible damage to such opening region there can be nonetheless accomplished the positive product opening at the correct location.

Attached to the angle iron member 21 is a guide body 26 having two recesses 26*a* and 26*b*, as best seen by referring to FIG. 3, in which there are laterally guided the bending spring elements 22 and 23, respectively. At the underside of the free end 23*a* of the bending spring element 23, which serves as holder element, there is arranged a support element 27. This support element 27 bears by means of an inclined surface 27*a* upon a guide surface 28 of the guide body 26. This guide surface 28 ascends towards the interior of the compartment 8.

In FIG. 3 there has been indicated by the arrow B the direction in which the printed products 13 are to be displaced in the direction of the lengthwise axis of the cell wheel 1 in a manner as has already been explained. With respect to this direction of movement B the holder element 23*a* is arranged behind the pre-separation element 22*a*, 24. In FIG. 3 there is furthermore shown a stationary separation element 29 constructed as a spreading wedge, which is arranged after the holder element 23*a*, viewed with respect to the direction of movement B of the printed product 13. This separation element 29, as explained in detail in the aforementioned U.S. Pat. No. 3,951,399, serves for the complete opening of the printed product 13.

Additionally, in FIG. 3 the respective arrows C and D represent the direction in which the arm 22*a* along with the entrainment cam or dog 24 and the holder element 23*a*, respectively, are moved within the compartment 8 towards the printed product 13. Both of the movement directions C and D extend essentially parallel to one another and approximately at right angles to the feed or advance direction B of the printed product 13.

Having now had the benefit of the foregoing description of the apparatus for opening printed products as contemplated by the invention there will be described the product opening operation which is as follows:

As long as the bending spring elements 22 and 23 are located, during revolving of the cell wheel 1, externally of the effective region of the cam or bracket elements 11 and 12 or the like, the free ends 22*a* and 23*a* of such bending spring elements 22 and 23 are in their retracted, rear position where they are held owing to the spring action of the correspondingly formed and clamped rear portion of the bending spring elements 22 and 23. In this retracted position both the entrainment cam 24 and also the holder element 23*a* are without effect upon the printed product 13 located in the compartment 8. Upon insertion of the printed products into the compartments 8 of the infeed portion or region 5 of the cell wheel 1 these printed products 13 come to bear upon the support surfaces 9*a* of the partition walls 9 as well as with the corner E which is to be opened upon the arm 22*a* which ascends in relation to the support surface 9*a*, as such has been illustrated in the uppermost compartment 8 of the three compartments shown in FIG. 2 and in FIG. 3. During the subsequent opening operation the printed product 13 is not moved.

As will be seen by referring to FIG. 2, during rotation of the cell wheel 1 initially the bending spring element 22 travels with its rear portion upon the control cam surface 11*a* of the cam 11 (uppermost compartment of FIG. 2). Under the action of such control cam surface 11*a* the arm 22*a* together with the entrainment cam or dog 24 is moved in the direction of the arrow C (FIG. 3) towards the open side 15 of the printed product 13. As will be seen based upon the intermediate portion of FIG. 2, during this forward movement of the arm 22*a* the entrainment cam 24 engages the corner region E of the lap margin part 13*b* of the printed product 13 and entrains the seized or engaged product sheets during its further movement. This now results in a doming or bowing-out of the sheets at the corner region E and which have been entrained by the entrainment cam 24. Due to this bowing-out of the product, portion 13*b* the sheets of the portion 13*a* located thereabove are raised, and a gap S is formed between both parts or portions 13*a* and 13*b* which are to be separated from one another.

Since at this point in time also the other bending spring element 23 begins to travel at its rear, clamped portion onto the control cam surface 12*a* of the other cam 12, there occurs a radial advance displacement of the holder element 23*a* in the direction of the arrow D (FIG. 3). Due to the inclined guide surface of the guide body 26 there is accomplished simultaneous with the forward advance or feed of the holder element 23*a* a gradual lifting thereof. With its forward end the holder element 23*a* enters the gap S and engages below the raised upper portion or part 13*a* of the printed product, as the same has been illustrated in conjunction with the lowermost compartment of FIG. 2. During further rotation of the cell wheel 1 the bending spring element 22 now moves off of its control cam surface or control cam 11*a*, which results in the arm 22*a* along with the entrainment cam 24 being retracted out of the compartment 8 into its rest position due to the restoring spring action of the rear portion of the bending spring element 22. As a result there disappears the bowing-out of the lower portion 13*b* at the corner region E, but the printed product is maintained open at this corner region by the holder element 23*a*, against which bears the upper part or portion 13*a*.

After the arm 22*a* and the entrainment cam 24 have retracted to such an extent that the cam 24 is no longer in engagement with the printed product 13, then the printed product 13 is advanced in the direction of the arrow B in the described manner. During the course of this feed or advance movement the printed product travels on to the separation element 29, which moves into the gap S which has been held open by the holder element 23*a*, and the two parts 13*a* and 13*b* completely separated from one another, as such has been described in detail in U.S. Pat. No. 3,951,399. The bending spring element 23 not likewise moves off of its control cam surface 12*a* and is moved back into the rest position due to the restoring spring characteristic of the clamped rear portion. It is now possible to stuff, for instance, further printed products into the printed product 13 which has been opened in the described manner, and which stuffing operation has been explained in the mentioned U.S. Pat. No. 3,951,399.

By virtue of the fact that the printed product 13 is stationary during the opening operation, there is possible a faultless opening at the desired location of the product. Since the printed product 13 only then is moved when the entrainment cam 24 is located externally of the path of movement of the printed product 13, there is avoided any impairment of this feed movement or, in fact, damage to the printed product 13 by the cam 24. The holder element or holder 23*a* is provided with a smooth contact surface, so that there can be prevented any damage to the printed product 13 during the forward movement.

As particularly evident by referring to FIG. 2, the opening of the printed products 13 with a pre-fold is accomplished exactly at the centre, since the entrainment cam 24 presses upon one-half of the sheets. Products without any pre-fold however can be opened at a random location, and to this end it is necessary, by appropriately constructing the entrainment cam 24, to determine the number of sheets which must be engaged by the entrainment cam 24.

It should be understood that the pre-separation element 22*a*, 24 and the holder element 23*a* also can be constructed differently than illustrated. Moreover, it is possible to control the movement of the pre-separation and holder elements in a manner different than illustrated.

Instead of an entrainment cam 24 engaging at the open side 15, it would be possible for the pre-separation element to possess, for instance, also a suction cup or element which can be connected to a negative pressure source, this suction cup travelling below the sheets which are to be entrained, retaining such by a suction action and entraining them during the further movement.

It is also conceivable to move the product to be opened with its open side towards the stationary pre-separation element. The pre-opening operation occurs in appropriate manner by bowing-out the sheets which are fixedly retained by the pre-separation element and thus prevented from participating in any further movement. After the insertion of the holder element the product can be further moved in one direction, which extends transversely to its previous direction of movement. Additionally, both the pre-separation element and also the product can be moved towards one another.

Instead of using a stationary separation element, towards which there is moved the product, it is possible to insert a moveably constructed separation element into the opening S at the stationary or moved product.

Although the described apparatus is particularly suitable for opening thin products having a pre-fold, it is possible to open in the described manner of course also other multi-sheet articles or products, which are folded, stitched or bound, i.e. where the sheets are interconnected with one another at least at one side.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A method of opening folded, bound or stitched, multi-sheet products, especially printed products, each having a folded edge and an opposite open side having a lap margin part, comprising the steps of:

moving a pre-separation element relative to the product towards the open side thereof and engaging an edge of the lap margin part of said open side;

moving the engaged lap margin edge of the open side relative to and toward said folded edge;

continuing the relative movement of the pre-separation element and the lap margin edge engaged thereby so that there occurs a bowing-out of the sheets;

inserting a holder element into an opening formed between the bowed-out sheets and remaining sheets of the product not engaged by the pre-separation element; and bringing to bear the sheets of the product not engaged by the pre-separation element against the holder element.

2. The method as defined in claim 1, further including the steps of:

following the insertion of the holder element rendering ineffectual the action of the pre-separation element at the product.

3. The method as defined in claim 2, further including the steps of:

following the insertion of the holder element introducing a stationary separation element into the opening between the sheets in order to completely open the product; and moving the product in a direction extending transversely with respect to the direction of the relative movement between the pre-separation element and the product towards the stationary separation element and after the pre-separation element has been placed into an ineffectual position with respect to the product.

4. The method as defined in claim 1, further including the steps of:

placing the product with a flat side thereof so as to bear upon a support.

5. The method as defined in claim 1, further including the steps of:

moving the holder element essentially parallel to a direction of movement of the pre-separation element and the product.

6. The method as defined in claim 1, further including the steps of:

following the insertion of the holder element introducing a separation element into the opening between the sheets in order to completely open the product.

7. An apparatus for opening folded, bound or stitched, multi-sheet products, especially printed products, each having a folded edge and an opposite open side having a lap margin part, comprising:

a pre-separation element for acting upon the lap margin part of the open side of the sheets of the product for displacing such lap margin part of the open side of the sheets in relation to remaining sheets of the products which are not engaged by the pre-separation element;

means for moving the pre-separation element relative to the product towards the open side thereof and for engaging and moving an edge of the lap margin part of at least one of the open sides of the sheets relative to and towards the folded edge by said pre-separation element;

said engaged lap margin part of the open side of the sheets being bowed out at the lap margin part where such sheets are engaged by the pre-separation element during continued relative movement between the pre-separation element and the product;

a holder element introduceable into an opening between the bowed-out sheets and the remaining sheets of the product not engaged by the pre-separation element; and said sheets which are not engaged by the pre-separation element coming to bear upon said holder element.

8. The apparatus as defined in claim 8, wherein:

said pre-separation element is movable following the insertion of the holder element into a position where it no longer exerts the bowing-out action upon the product.

9. The apparatus as defined in claim 8, further including:

a stationary element for the complete opening of the product;

said separation element being introduceable into the opening between the sheets following the insertion of the holder element; and the product being movable in a direction extending transversely with respect to the direction of relative movement between the pre-separation element and the product towards the stationary separation element after the pre-separation element has been brought into an ineffectual position with respect to the product.

10. The apparatus as defined in claim 7, further including:

support means for the product;

the product bearing at a flat side thereof upon said support means; and said pre-separation element being effectual at the lap margin part of the sheets of the product at the side of the support means.

11. The apparatus as defined in claim 10, wherein:

said pre-separation element comprises an entrainment member secured to an arm;

said entrainment member acts upon the lap margin part of the sheets of the product;

said arm protrudes past said entrainment member; and said arm is inclined at an acute angle with respect to said support means for the product.

12. The apparatus as defined in claim 8, wherein: the holder element is moved in a direction essentially parallel to a direction of movement of the pre-separation element and the product.

13. The apparatus as defined in claim 8, further including:

a separation element for the complete opening of the product; and said separation element being introduceable into the opening between the sheets following insertion of the holder element.

14. The apparatus as defined in claim 8, wherein:

said pre-separation element comprises an entrainment member secured to an arm; and said entrainment member acts upon the lap margin part of the sheets of the product.

15. The apparatus as defined in claim 15, further including:

control means for controlling the movement of the pre-separation element; and said arm bearing under spring force at said control means.

16. The apparatus as defined in claim 16, wherein:

said control means comprises control cam means for controlling said movement of the pre-separation element.

17. The apparatus as defined in claim 16, wherein:

said arm is constituted by a free end of a bending spring element which is clamped at one side; and said bending spring element contacts said control means.

18. The apparatus as defined in claim 15, further including:

additional control means for controlling the movement of the holder element; and said holder element having an elongated configuration and bearing under spring force at said additional control means.

19. The apparatus as defined in claim 19, wherein:

said additional control means comprises an additional control cam means for controlling said movement of said holder element.

20. The apparatus as defined in claim 19, wherein:

the holder element is formed by the free end of a bending spring element which is clamped at one end; and said bending spring element is in contact with said additional control means.

21. The apparatus as defined in claim 8, wherein: direction of movement of the holder element is inclined with respect to a flat side of the product.

22. An apparatus for processing folded, bound or stitched, multi-sheet products, each having a folded edge and an opposite open side having a lap margin part, comprising:

a cell wheel rotatable about an axis of rotation;

said cell wheel being provided with radially extending compartments for receiving the printed products and in which the printed products are movable in the direction of the axis of rotation of the cell wheel;

each of said individual compartments being provided at least at an input portion thereof with a device for opening the printed products;

each said opening device comprising:

a pre-separation element acting upon the lap margin part of the open side of the sheets of the product for displacing such lap margin part of the open side of the sheets in relation to the remaining sheets of the product which are not engaged by said pre-separation element;

means for moving the pre-separation element relative to the product towards the open side thereof and for engaging and moving an edge of the lap margin part of the open side of the sheets relative to and towards the folded edge by said pre-separation element;

said engaged lap margin part of the open side of the sheets being domed-out at the lap margin part where such sheets are engaged by the pre-separation element during continued relative movement between the pre-separation element and the product;

a holder element introduceable into an opening between the doomed-out sheets and the remaining sheets which are not engaged by the pre-separation element; and said sheets which are not engaged by the pre-separation element coming to bear upon said holder element.

* * * * *